US005674029A

United States Patent [19]

Smith et al.

[11] Patent Number: 5,674,029

[45] Date of Patent: Oct. 7, 1997

[54] WEIR

[75] Inventors: Martin A. Smith, Port Coquitlam; Douglas F. Sommerville, West Vancouver; Peter W. Emmett, Maple Ridge; John R. Gaetz, New Westminster, all of Canada

[73] Assignee: UV Waterguard Systems, Inc., Port Moody, Canada

[21] Appl. No.: 365,038

[22] Filed: Dec. 28, 1994

[51] Int. Cl.[6] ..... E02B 8/06

[52] U.S. Cl. ..... 405/108; 405/80; 405/39

[58] Field of Search ..... 405/87, 80, 88, 405/107, 108, 39, 118, 101, 92

[56] References Cited

U.S. PATENT DOCUMENTS

| | | | |
|---|---|---|---|
| 840,042 | 1/1907 | Church | 405/108 |
| 991,907 | 5/1911 | Stickney | 405/108 |
| 1,052,338 | 2/1913 | Holmes | 405/108 |
| 1,083,995 | 1/1914 | Davis et al. | 405/108 |
| 1,206,938 | 12/1916 | Stimmel et al. | 405/80 |
| 1,393,389 | 10/1921 | Parker | 405/107 |
| 1,404,092 | 1/1922 | Chapman et al. | 405/108 |
| 2,171,560 | 9/1939 | Holmes et al. . | |
| 2,762,202 | 9/1956 | Ponsar | 405/118 |
| 3,070,963 | 1/1963 | Dubouchet . | |
| 3,555,829 | 1/1971 | Trewhella | 405/87 |
| 3,665,714 | 5/1972 | Bunger . | |

FOREIGN PATENT DOCUMENTS

| | | | |
|---|---|---|---|
| 5280028 | 10/1993 | Japan | 405/80 |
| 1335817 | 9/1987 | U.S.S.R. | 405/108 |
| 347502 | 4/1931 | United Kingdom | 405/108 |
| 876107 | 8/1961 | United Kingdom | 405/108 |

*Primary Examiner*—Tamara L. Graysay
*Assistant Examiner*—Frederick L. Lagman
*Attorney, Agent, or Firm*—Oppenheimer Poms Smith

[57] ABSTRACT

A weir structure for controlling liquid flow in a channel having a floor and side walls comprising a barrier extending between the sidewalls of the channel and from the floor of the channel to a crest to separate the channel into an upstream region and a downstream region. Fluid in the channel flows from the upstream region to the downstream region by overflowing the barrier at the crest. The barrier is formed with at least one passage through the barrier positioned and dimensioned to allow for free, unregulated fluid flow through the passage from the upstream region to the downstream region whenever fluid is overflowing the barrier to increase flow past the barrier.

1 Claim, 2 Drawing Sheets

WEIR

FIELD OF THE INVENTION

This invention relates to a weir structure for controlling flow in a channel

BACKGROUND OF THE INVENTION

Weirs are commonly used to control and measure liquid flows in open channels. A weir can be defined as any regular obstruction over which a flow occurs.

Flow in a channel over a weir can be usually be approximated by the equation:

$$Q = K\sqrt{2(g)}\ LH^{3/2}$$

where:

Q=flow over the weir in $m^3/s$ k=a constant g=acceleration due to gravity (9.81 $m/s^2$)

L=length across the weir (m)

H=depth of fluid over the weir crest (m)

Accordingly, flow Q is directly proportional to the length L of the weir across the channel and proportional to the depth of fluid overflowing the weir crest. Therefore, increasing the length L of the weir or the depth of fluid at the weir crest will allow for increased flow over the weir.

In many open channel flow applications, the dimensions of the channel are pre-determined and it is not possible to adjust these dimensions due to site or budget constraints. The channel dimensions limit the length of the weir and often the depth of flow over the weir.

Various weir systems have been developed to control flow in channels. Examples of such systems include:

U.S. Pat. No. 2,171,560 to Holmes

U.S. Pat. No. 3,070,963 to Dubouchet

U.S. Pat. No. 3,665,714 to Bunger

U.S. Pat. Nos. 3,070,963 and 3,665,714 rely on mechanical gates that open and close to control the flow of water past a barrier in a channel. Such an arrangement tends to result in water level fluctuations in the channel as the gates opens and closes. As well, the gate mechanisms are prone to wear and require maintenance.

SUMMARY OF THE INVENTION

Applicant has developed a weir system that addresses the problems of the prior art and permits increased flow past a weir for a given set of channel dimensions without using pivoting gates. This is accomplished by providing a conventional weir with at least one passage through the weir positioned and dimensioned to carry fluid flow only when fluid is overflowing the weir. The passage acts to effectively increase the length of the weir to increase flow past the weir. Because the passage is positioned and dimensioned to carry flow only when fluid is overflowing the weir, there is no need for the pivoting mechanical gates of the prior art to restrict fluid flow through the passages bypassing the weir.

Accordingly, the present invention provides a weir structure for controlling liquid flow in a channel having a floor and side walls comprising:

a barrier extending between the sidewalls of the channel and from the floor of the channel to a crest to separate the channel into an upstream region and a downstream region, fluid in the channel flowing from the upstream region to the downstream region by overflowing the barrier over the crest; and at least one passage through the barrier positioned and dimensioned to allow for free, unregulated fluid flow through the passage from the upstream region to the downstream region whenever fluid is overflowing the barrier to increase flow past the barrier.

Multiple passages can be formed through the weir to establish substantially plug flow through the upstream channel rather than the natural distributed velocity flow in which frictional resistance at the sidewalls and floor slow the flowrate.

BRIEF DESCRIPTION OF THE DRAWINGS

Aspects of the present invention are illustrated, merely by way of example, in the accompanying drawings in which.

DESCRIPTION OF THE PREFERRED EMBODIMENTS

Figure 1:
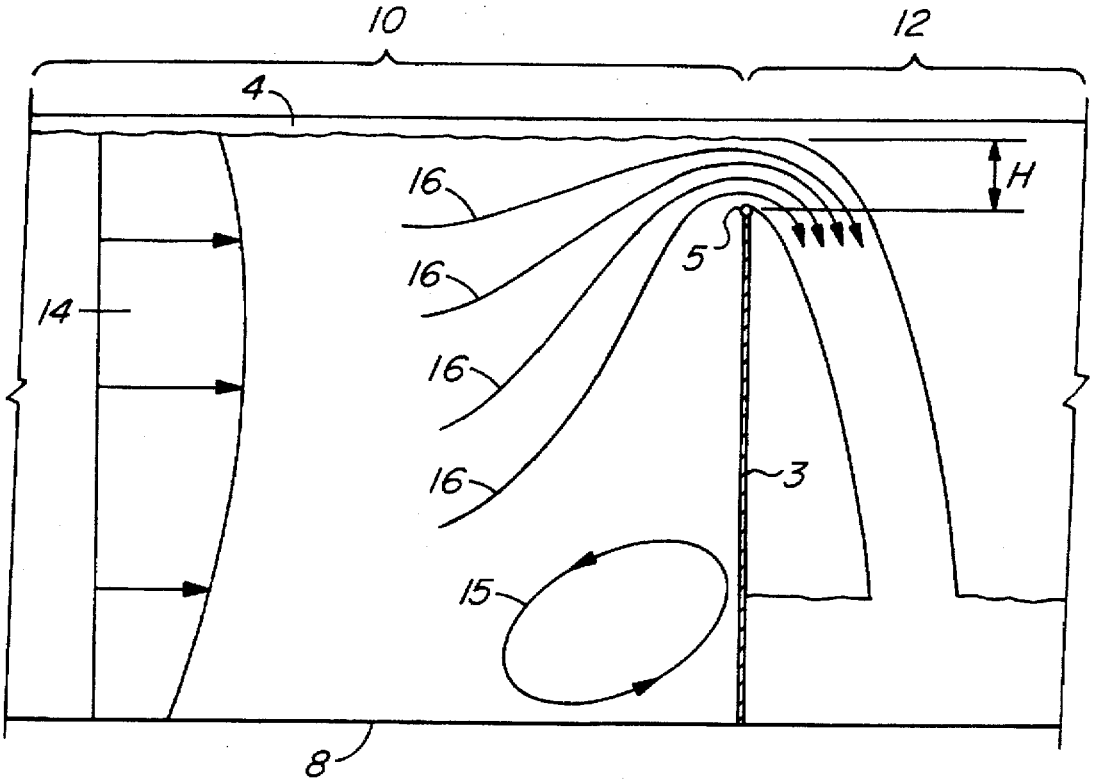
FIG. 1 is a cross-sectional view of a conventional weir structure in a channel showing flow patterns.

FIG. 1 schematically shows a conventional weir comprising a barrier 3 positioned in a channel 4 having side walls 6 and a floor 8. The barrier has a length L which is also the width of channel 4. Fluid from the upstream region of the channel 10 overflows the weir 2 at crest 5 to a depth H and flows into the downstream region 12. Due to frictional resistance at the side walls and the floor, the flow in the channel tends to adopt the velocity profile 14 illustrated in FIG. 1 with flow at the surface and the channel floor being slowest. In addition, due to barrier 3, flow at 15 tends to be circular. The fluid at the floor of the channel is forced to rise to overflow the barrier 3 leading to the flow lines indicated by arrows 16.

Figure 2:
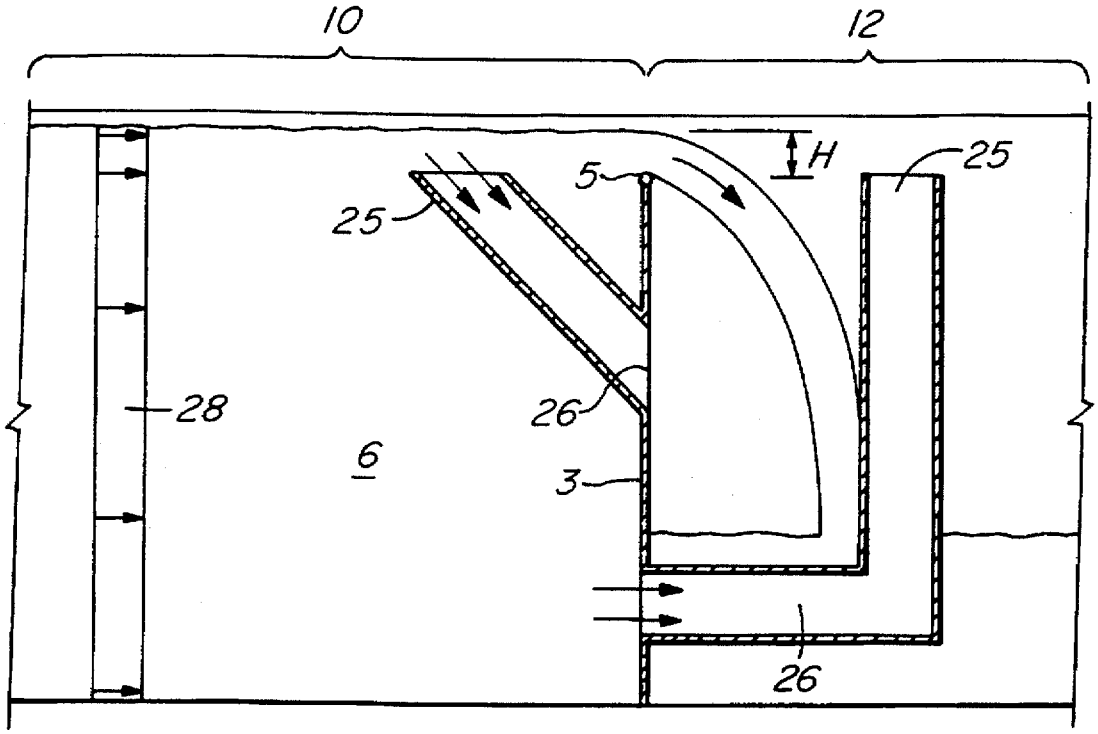
FIG. 2 is a cross-schematic view of the weir structure of the present invention showing a cross-section view of a preferred embodiment of the invention.
Figure 3:
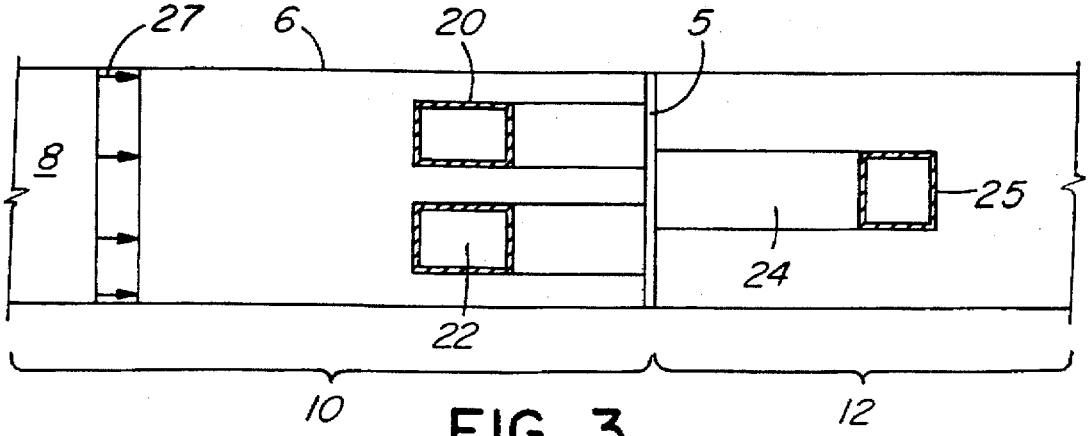
FIG. 3 is a plan view of the embodiment of FIG. 2.

FIGS. 2 and 3 illustrate a weir structure according to the present invention in which the same reference numerals as used in FIG. 1 are used to identify the same elements. The weir structure of the present invention includes a barrier 3 extending between the sidewalls 6 of channel 4 and from floor 8 of the channel to a crest 5 to separate the channel 4 into an upstream region 10 and a downstream region 12. In addition, barrier 3 is formed with at least one passage through the barrier positioned and dimensioned to allow for free, unregulated fluid flow through the passage whenever fluid is overflowing the barrier. Since flow Q over a weir is theoretically governed by the equation $Q=K\sqrt{2(g)}LH^{3/2}$, as explained previously, the at least one passage acts to increase the effective length of the weir L between the side walls 6. Therefore, flow Q over the barrier is increased while the physical dimensions of the barrier and channel remain unchanged and the depth of flow H over the barrier is kept constant.

In the illustrated embodiment of FIGS. 2 and 3, the barrier 3 is formed with three passages 20, 22 and 24. Each passage comprises a hollow pipe having open ends. Each pipe has an upper pipe end 25 that is level with the barrier crest 5 on one side of the barrier and a lower pipe end 26 that is located on the other side of the barrier below the barrier crest. By making end 25 of each pipe level with the barrier crest, flow through the pipe only occurs when fluid reaches a level sufficient to overflow the barrier. This prevents the pipes from siphoning fluid from the upstream region 10 to the downstream region 12.

There are two types of passages illustrated in FIGS. 2 and 3. Passages 20 and 22 have upper ends 25 or inlets located in the upstream region 10 for collecting flow adjacent the fluid surface. The lower ends 26 or outlets of passages 20 and 22 are formed in barrier 3 and deliver fluid to downstream region 12. Passages of this type are well suited for positioning adjacent the side walls 6 of a channel for collecting and increasing the slower flow fluid adjacent the side walls. As shown in FIG. 3, the passages 20 and 22 tend to even out the velocity profile 27 of flow across channel 4 by increasing the flow velocity at the side walls.

The second type of passage 24 has a lower end 26 that acts as an inlet in the upstream region for collecting flow adjacent floor 8 of channel 4 and an upper end 25 that acts as an outlet into the downstream region. Lower end 26 is formed in barrier 3. This type of passage is suited for substantially reducing the eddy flow 15 (FIG. 1) that develops behind a conventional weir. Flow adjacent channel floor 8 and barrier 3 is collected by passage 24 for delivery to downstream region 12.

Acting together, passages 20, 22 and 24 act to substantially equalize the velocity profile 28 (FIG. 2) through the depth of fluid flowing in channel 4. In effective, the passages tend to establish uniform plug flow through channel 4. It will be understood that the passages of the weir structure of the present invention can be organized into various arrangements according to the configuration of the channel system in which the weir is being installed to collect surface flow and to collect flow adjacent the floor of the channel to increase the flow of fluid past barrier 3.

Although the present invention has been described in some detail by way of example for purposes of clarity and understanding, it will be apparent that certain changes and modifications may be practised within the scope of the appended claims.

I claim:

1. A weir structure for controlling liquid flow in a channel having a floor and side walls comprising:

a barrier extending between the sidewalls of the channel and from the floor of the channel to a crest to separate the channel into an upstream region and a downstream region, fluid in the channel flowing from the upstream region to the downstream region by overflowing the barrier over the crest;

at least two passages through the barrier positioned and dimensioned to allow for free, unregulated fluid flow through the passage from the upstream region to the downstream region only when fluid is overflowing the barrier, each passage comprising a hollow pipe having an upper end level with the barrier crest on one side of the barrier and a lower end located on the other side of the barrier below the barrier crest;

one of the at least two passages having its upper end located in the upstream region as an inlet for collecting flow adjacent the fluid surface and the lower end located in the downstream region as outlet;

the other of the at least two passages having its lower end located in the upstream region as an inlet for collecting flow adjacent the floor of the channel and its upper end located in the downstream region as an outlet.

* * * * *